US009927753B2

(12) United States Patent
Takahashi et al.

(10) Patent No.: US 9,927,753 B2
(45) Date of Patent: Mar. 27, 2018

(54) IMAGE FORMING APPARATUS

(71) Applicant: CANON KABUSHIKI KAISHA, Tokyo (JP)

(72) Inventors: Keita Takahashi, Abiko (JP); Shinnosuke Iwadate, Toride (JP); Teruhito Kai, Kashiwa (JP); Hiroto Nishihara, Tsukuba (JP); Hiromi Shimura, Toride (JP); Kentaro Tamura, Komae (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/352,391

(22) Filed: Nov. 15, 2016

(65) Prior Publication Data

US 2017/0139364 A1 May 18, 2017

(30) Foreign Application Priority Data

Nov. 18, 2015 (JP) ..... 2015-225697

(51) Int. Cl.
*G03G 15/00* (2006.01)

(52) U.S. Cl.
CPC ..... *G03G 15/5062* (2013.01); *G03G 15/6511* (2013.01); *G03G 15/6514* (2013.01); *G03G 15/6552* (2013.01); *G03G 2215/00392* (2013.01); *G03G 2215/00396* (2013.01); *G03G 2215/00734* (2013.01); *G03G 2215/00751* (2013.01); *G03G 2215/0132* (2013.01)

(58) Field of Classification Search
CPC ..... G03G 15/5029
USPC ..... 399/389
See application file for complete search history.

(56) References Cited

U.S. PATENT DOCUMENTS 6,053,495 A * 4/2000 Hara ..... B65H 7/125 271/258.01
6,148,172 A * 11/2000 Kanda ..... B65H 3/44 271/242
8,123,212 B1 * 2/2012 Blair ..... B65H 1/14 271/117
9,302,863 B1 * 4/2016 Piening ..... B65H 3/0684
2011/0085840 A1 * 4/2011 Shiohara ..... B65H 1/266 400/578
2014/0319756 A1 * 10/2014 Hirahara ..... B65H 3/0684 271/117

FOREIGN PATENT DOCUMENTS

JP 11-189344 A 7/1999

* cited by examiner

*Primary Examiner* — Anthony Nguyen
(74) *Attorney, Agent, or Firm* — Canon U.S.A., Inc. IP Division

(57) ABSTRACT

An image forming apparatus includes a feeder including a tray and a pickup member, a size determiner, a sheet type setter, and a controller. The tray stacks a sheet thereon, and the pickup member feeds a contacted sheet. The feeder switches between a first state where the pickup member and the stacked sheet are in contact and a second state where the pickup member and the stacked sheet are separate. The size determiner determines a stacked sheet size. The sheet type setter sets a stacked sheet type. Where the type of the set sheet is a first type, the feeder switches from the second state to the first state when the size of the sheet is determined. Where the type of the set sheet is a second type, the feeder refrains from switching from the second state to the first state even when the size of the sheet is determined.

15 Claims, 11 Drawing Sheets

IMAGE FORMING APPARATUS

BACKGROUND OF THE INVENTION

Field of the Invention

Aspects of the present invention generally relate to control of a manual feed tray in an image forming apparatus.

Description of the Related Art

Image forming apparatuses of the electrophotographic type configured to feed sheets placed on a sheet feed cassette or a manual feed tray to perform image formation. Nowadays various types of sheets are available in the marketplace. Under such circumstances, a manual feed tray is used to feed, for example, sheets of grammages that do not comply with sheet feed cassettes, sheets of coated paper having a slippery surface property, and long sheets greater in length than currently available sheets. Japanese Patent Application Laid-Open No. 11-189344 discusses an image forming apparatus having a mode for causing a bottom plate to lower to such a position as to disable feeding of sheets each time image formation is completed and a mode for causing the bottom plate to be held in such a position as to enable feeding of sheets even after image formation is completed. In such an image forming apparatus, selecting any one of the modes is allowed. In the case of such a manual sheet feed device, when runout of sheets in the manual sheet feed device during image formation is detected, the bottom plate is caused to lower so as to enable replenishment of sheets, so that user operability is improved. Moreover, for example, since the bottom plate is caused to lift at the timing when sheets are set on the manual feed tray, a time required to output the first sheet is shortened, so that user operability is further improved.

However, conventional configurations have the following issues. In the above-mentioned image forming apparatus, the bottom plate lifts even when any type of sheet, such as a sheet with special ink coated thereon, for example, carbon paper or non-carbon paper, is set on the manual feed tray. Therefore, lifting of the bottom plate brings a sheet feed roller and the sheet into contact with each other, and such a contact state is maintained. This may lengthen the time for which the sheet feed roller and the sheet are in contact with each beyond necessity. In this case, for example, ink attached to the sheet, paper powder, or loading material of paper may adhere to the sheet feed roller. If, for example, ink, paper powder, or loading material of paper adheres to the sheet feed roller, soiling of the sheet feed roller may cause soiling of sheet subsequently conveyed or a conveyance failure, such as slippage of the sheet feed roller.

SUMMARY OF THE INVENTION

Aspects of the present invention are generally directed to reducing an image defect or a conveyance failure without decreasing user operability.

According to an aspect of the present invention, an image forming apparatus includes a feeder including a tray configured to stack a sheet thereon and a pickup member configured to contact the sheet stacked on the tray and to feed the contacted sheet, wherein the feeder is configured to switch between a first state in which the pickup member and the sheet stacked on the tray are in contact with each other and a second state in which the pickup member and the sheet stacked on the tray are separate from each other, a size determiner configured to determine a size of the sheet stacked on the tray, a sheet type setter configured to set a type of the sheet stacked on the tray, and a controller configured to control the feeder, wherein, in a case where the type of the sheet set by the sheet type setter is a first type, the controller controls the feeder in such a way that the feeder switches from the second state to the first state when the size of the sheet is determined by the size determiner, and wherein, in a case where the type of the sheet set by the sheet type setter is a second type, the controller controls the feeder in such a way to cause the feeder to refrain from switching from the second state to the first state even when the size of the sheet is determined by the size determiner.

Further features of the present invention will become apparent from the following description of exemplary embodiments with reference to the attached drawings.

BRIEF DESCRIPTION OF THE DRAWINGS

FIG. 9 is a flowchart illustrating processing for control performed at the time of power-on.

DESCRIPTION OF THE EMBODIMENTS

Various exemplary embodiments, features, and aspects of the invention will be described in detail below with reference to the drawings.

<Schematic Configuration of Image Forming System>

Figure 1:
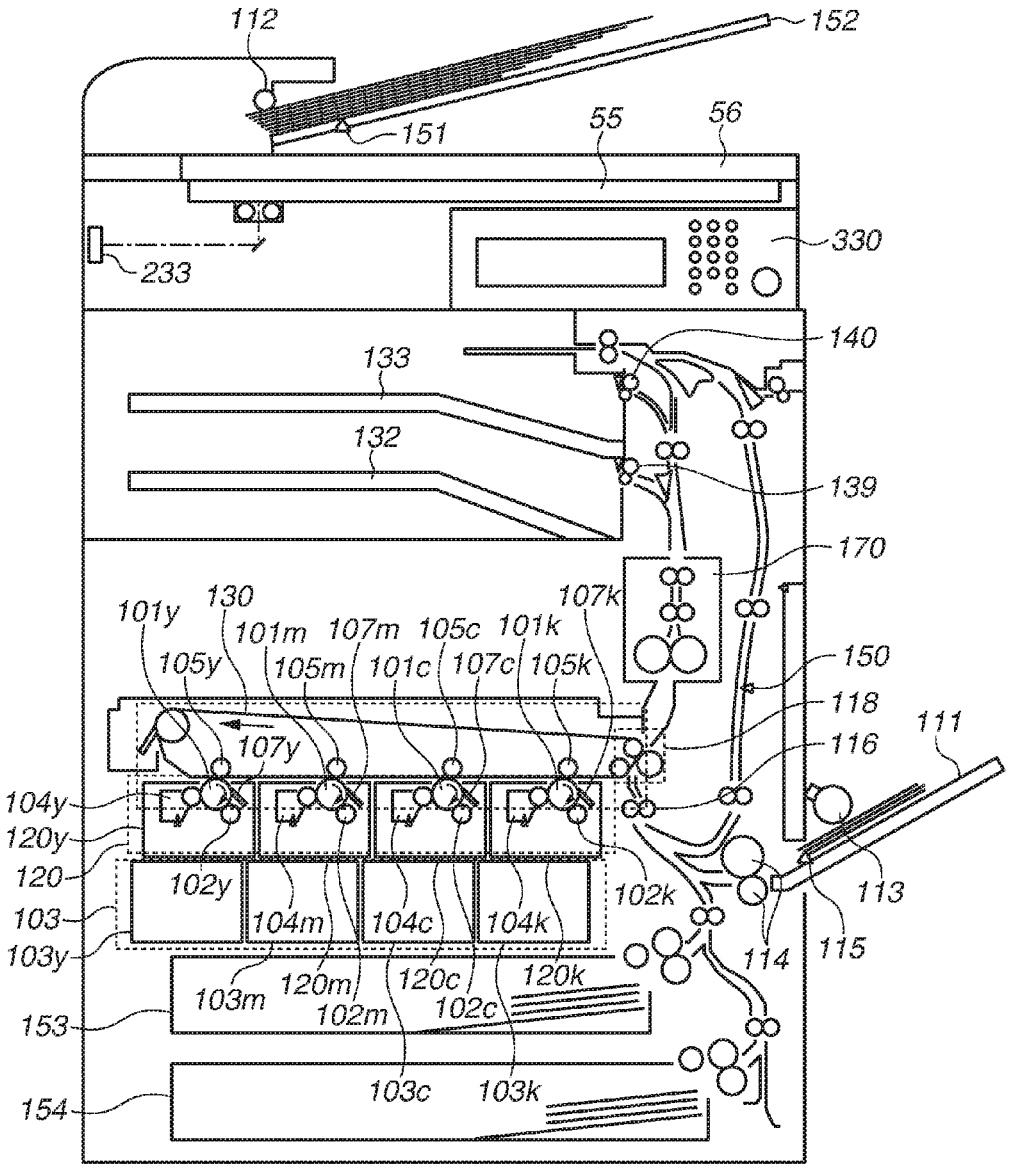
FIG. 1 is across-sectional view of an image forming apparatus.
Figure 2:
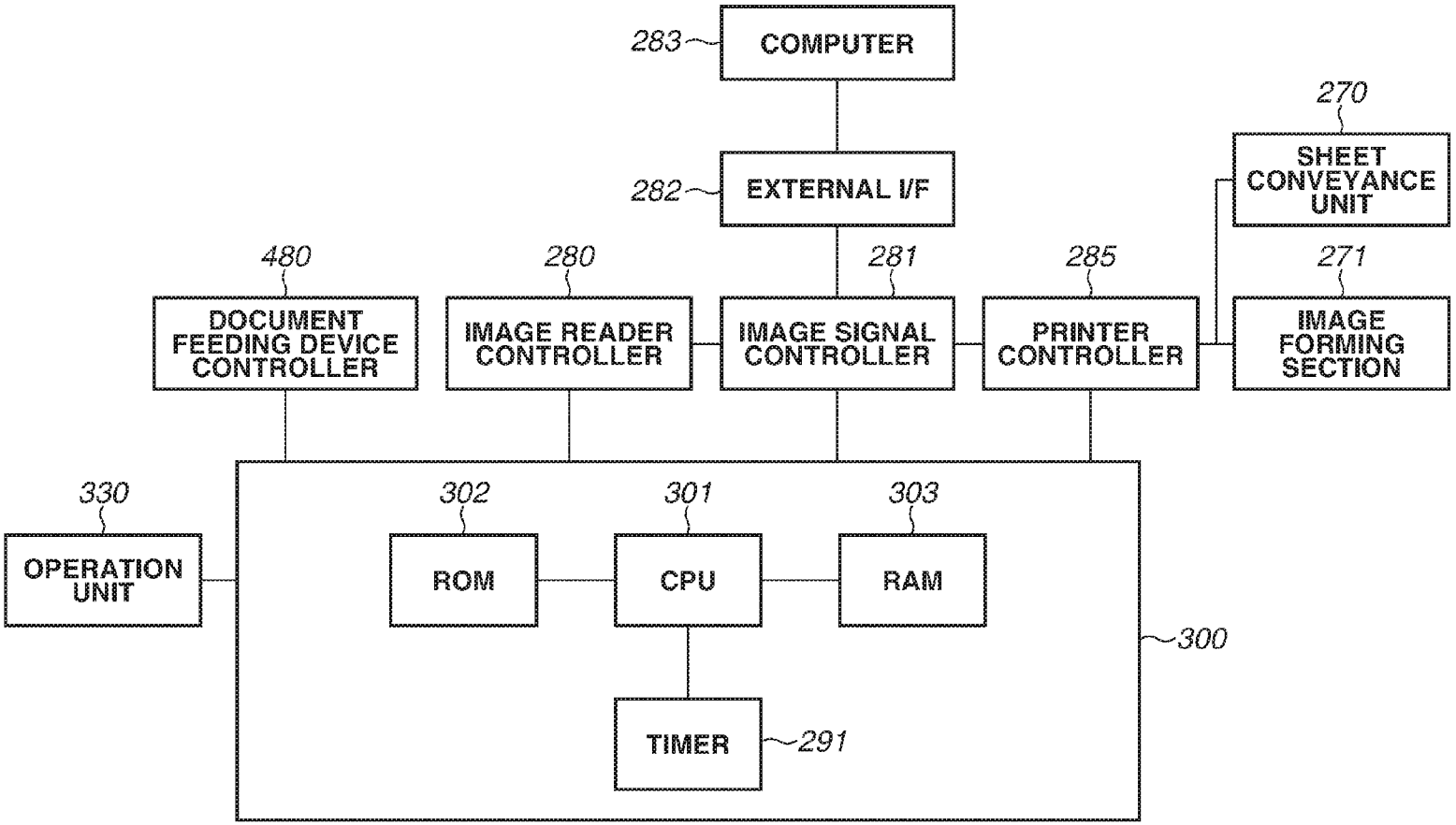
FIG. 2 is a block diagram of the image forming apparatus.

FIG. 1 is a cross-sectional view of an image forming apparatus according to an exemplary embodiment, and FIG. 2 is a block diagram of the image forming apparatus according to the present exemplary embodiment. A basic configuration is described with reference to FIGS. 1 and 2.

[Schematic Configuration of Image Forming Apparatus]

A control unit 300 illustrated in FIG. 2, which performs system control of the image forming apparatus illustrated in FIG. 1, includes a central processing unit (CPU) 301, a read-only memory (ROM) 302, a random access memory (RAM) 303, and a timer 291. The CPU 301 performs system control of the image forming apparatus. A control program to be executed by the CPU 301 is written in the ROM 302, and variables to be used for control and image data read by an image sensor 233 illustrated in FIG. 1 are stored in the RAM 303. The ROM 302 and the RAM 303 are connected to the CPU 301 via an address bus and a data bus. Moreover, the timer 291, which is able to measure time, is connected to the CPU 301, and the CPU 301 performs setting of a time count value for the timer 291 and acquisition of a timer measured value. The CPU 301 functions as a receiver that receives an instruction for starting image formation via an operation unit 330 or an external interface (I/F) 282. The CPU 301 performs driving of document conveyance roller 112 via a document feeding device control unit 480 and detection of the presence or absence or a document via a document presence/absence sensor 151. Furthermore, the CPU 301 performs detection of opening and closing operations of a document pressure plate and reading of a document image on a document positioning glass plate 55 or a document image fed by the document feeding device control unit 480 with an image sensor 233 via an image reader control unit 280. The image sensor 233 outputs information indicating the read document image as an analog image signal to the CPU 301. The CPU 301 transfers the analog image signal input from the image sensor 233 to an image signal control unit 281. Additionally, the document positioning glass plate 55, a document positioning plate 152, the document presence/absence sensor 151, the document conveyance roller 112, and the image sensor 233 constitute a reading unit that reads a document image.

The image signal control unit 281, when performing a copy operation, transforms the analog image signal input from the image sensor 233 into a digital image signal, then performs various processing operations on the digital image signal, transforms the digital image signal subjected to the various processing operations into a video signal, and outputs the video signal to a printer control unit 285. The copy operation as used herein refers to an operation in which the reading unit reads a document with the image sensor 233 and a printer unit performs printing based on data read from the document. Moreover, the image signal control unit 281, when performing a printing operation based on an instruction from the outside, first performs various processing operations on a digital image signal input from a computer 283 via the external I/F 282. Then, the image signal control unit 281 transforms the digital image signal subjected to the various processing operations into a video signal and outputs the video signal to the printer control unit 285.

The printer control unit 285 instructs an image forming section 271 to perform image formation based on an instruction from the CPU 301. The image forming section. 271 drives an image forming unit 120 based on the input video signal. Moreover, the printer control unit 285 causes a sheet conveyance unit 270 to perform feeding of sheets, serving as a recording material, conveyance control, and lifting and lowering operations of a sheet feed pickup roller 113 illustrated in FIG. 1, which is described below, based on an instruction from the CPU 301. More specifically, the printer control unit 285 detects presence or absence of a sheet or sheets on a sheet feed tray 111, serving as a stacking unit, illustrated in FIG. 1 with a sheet presence/absence sensor 115. When the sheet presence/absence sensor 115 detects that a sheet or sheets are present on the sheet feed tray 111 and a condition described below is satisfied, the printer control unit 285 performs a lowering operation of the sheet feed pickup roller 113, serving as a sheet feeding unit, with an lifting-lowering motor 163 (referring to FIGS. 5A, 5B, and 5C) serving as a drive source. Then, rotary driving of the sheet feed pickup roller 113 and sheet feed rollers 114 is performed with a sheet conveyance motor 164 (referring to FIG. 3A) serving as a drive source, so that a sheet is fed to a conveyance path.

The operation unit 330 is used to perform selection of a color mode in image formation, to display the status of the image forming apparatus, and to issue, for example, an instruction for starting of a copy operation. Moreover, when the CPU 301 detects that a sheet or sheets have been placed on the sheet feed tray 111, a sheet size selection screen is displayed on the operation unit 330. A setting value of the mode selected via the sheet size selection screen on the operation unit 330 is transmitted to the CPU 301, and the CPU 301 stores the received setting value of the mode into the RAM 303.

The image forming apparatus illustrated in FIG. 1 is provided with, in addition to the sheet feed tray 111, sheet feed cassettes 153 and 154 serving as sheet feeding units. Furthermore, a conveyance sensor 150 serving as a recording material detection unit used for conveyance control of sheets and detection of paper jam is provided on the conveyance path for sheets.

[Basic Image Forming Operation of Image Forming Apparatus]

Next, a basic image forming operation is described with reference to FIGS. 1 and 2. When the sheet presence/absence sensor 115 detects that a sheet or sheets have been placed on the sheet feed tray 111, the CPU 301 causes the operation unit 330 to display the sheet size selection screen. When a sheet size has been selected and determined by the user and the sheet size has transitioned from an undetermined state to a determined state, the CPU 301 performs the following control. More specifically, the CPU 301 moves the position of the sheet feed pickup roller 113 to a "sheet feed pickup roller contact position" with a lowering operation of the sheet feed pickup roller 113. The "sheet feed pickup roller contact position" as used herein refers to a position in which the sheet feed pickup roller 113 is in contact with a sheet placed on the sheet feed tray 111 to enable feeding of sheets. The sheet feed pickup roller 113 enters into a first state in which it is in contact with a sheet stacked on the sheet feed tray 111.

On the other hand, when detecting an instruction for print settings, such as color mode and the number of copies, input, from the operation unit 330 or opening and closing of the document pressure plate 56 or the placement of a document via the document feeding device control unit 480 or the image reader control unit 280, the CPU 301 performs a printing preparatory operation. More specifically, the printing preparatory operation is an operation that is performed. In response to the CPU 301 detecting that operations required for performing printing, such as an instruction for setting a print mode, opening and closing of the document pressure plate 56, the placement of a document, and the placement of a sheet or sheets on the sheet feed tray 111, are performed prior to an instruction for starting printing. These operations that are performed prior to an instruction for starting printing are operations based on which it is supposed that printing will be performed. The CPU 301 functions as a determiner that determines presence or absence of an operation supposed to be directed to execution of image formation. In the printing preparatory operation, the CPU 301 starts temperature control of a fixing device 170. Moreover, in a case where the following condition is satisfied, the CPU 301 moves the sheet feed pickup roller 113 to the "sheet feed pickup roller contact position". The following condition refers to a case where a sheet or sheets are placed on the sheet feed tray 111, the sheet size is already determined, and the position of the sheet feed pickup roller 113 is not the "sheet feed pickup roller contact position". Lifting and lowering operations of the sheet feed pickup roller 113 and details of the printing preparatory operation are described below.

Next, when receiving an instruction for starting a printing operation from, for example, the operation unit 330, the CPU 301 starts a reading operation for an image of the document via the document feeding device control unit 480.

The CPU 301 drives the document conveyance roller 112 via the document feeding device control unit 480 to feed the document from the document positioning plate 152, and performs reading of the document image. The document image is read by the image sensor 233, and image data indicating the read document image is output to the image signal control unit 281. Document reading continues until image reading of the last document is completed.

On the other hand, the CPU 301 controls the image forming unit 120 via the image forming section 271 to start an image forming operation for image data stored in the RAM 303. The image forming unit 120 includes a yellow image forming unit 120*y*, a magenta image forming unit 120*m*, a cyan image forming unit 120*c*, and a black image forming unit 120*k*. Hereinafter, suffixes y, m, c, and k indicating respective colors are omitted except, when needed. The image forming unit 120 is composed of mainly, a photosensitive drum 101, serving as a photosensitive member, a developing device 104, serving as a developing unit, a charging roller 102, and a photosensitive drum cleaner 107. In the image forming unit 120, after the surface of the photosensitive drum 101, which is rotating in a direction indicated by an arrow in FIG. 1 (clockwise direction), is electrostatically charged by the charging roller 102, a latent image is formed on the photosensitive drum 101 (on the photosensitive member) with a laser beam radiated from a laser scanner unit 103. Then, the latent image formed on the photosensitive drum 101, is developed on the photosensitive drum 101 with toner stored in the developing device 104. After that, the toner image formed on the photosensitive drum 101 is sequentially transferred in a superimposed manner onto an intermediate transfer belt 130, which is rotating in a direction indicated by an arrow in FIG. 1 (counterclockwise direction), by a primary transfer roller 105, to which a primary transfer voltage is applied, so that a full-color toner image is formed. The full-color toner image transferred onto the intermediate transfer belt 130 is moved to a secondary transfer unit 118 by the rotation of the intermediate transfer belt 130.

Furthermore, the CPU 301 drives a conveyance motor (not illustrated) via the sheet conveyance unit 270 in such a way that a sheet is matched with timing at which the toner image reaches the secondary transfer unit 118. The sheet feed pickup roller 113, the sheet feed rollers 114, a registration roller 116, and discharge rollers 139 and 140 are driven by the conveyance motor, serving as a drive source. With this, the sheet feed pickup roller 113 is driven to rotate, so that sheets are fed and conveyed one by one from the sheet feed tray 111. In the above-described way, as a secondary transfer voltage is applied at the secondary transfer unit 118, the toner image on the intermediate transfer belt 130 is transferred onto the sheet conveyed to the secondary transfer unit 118.

The sheet onto which the toner image has been transferred at the secondary transfer unit 118 is conveyed to the fixing device 170. In the fixing device 170, the unfixed toner image on the sheet is heated and pressed to be fixed to the sheet. After that, the CPU 301 discharges the sheet to a discharge tray 132 or a discharge tray 133 with a discharge roller 139 or a discharge roller 140, which is controlled by the sheet conveyance unit 270. After the printing operation is completed, the CPU 301 moves the sheet feed pickup roller 113 from the "sheet feed pickup roller contact position", in which the sheet feed pickup roller 113 is in contact with a sheet on the sheet feed tray 111, to a "sheet feed pickup roller separation position", in which the sheet feed pickup roller 113 is retracted above the sheet. The sheet feed pickup roller 113 enters into a second state in which the sheet feed pickup roller 113 is separate from a sheet stacked on the sheet feed tray 111. Hereinafter, the "sheet feed pickup roller contact position" referred to simply as a "contact position", and the "sheet feed pickup roller separation position" is referred to simply as a "separation position". Moreover, the above-described image forming operation is merely an example, and the present invention is not limited to the above-described configuration.

<Description of Lifting and Lowering Operations of Sheet Feed Pickup Roller>

Next, a lifting and lowering mechanism for the sheet feed pickup roller according to the present exemplary embodiment is described.

[Description of Sheet Feed Tray 111]

Figure 3A:
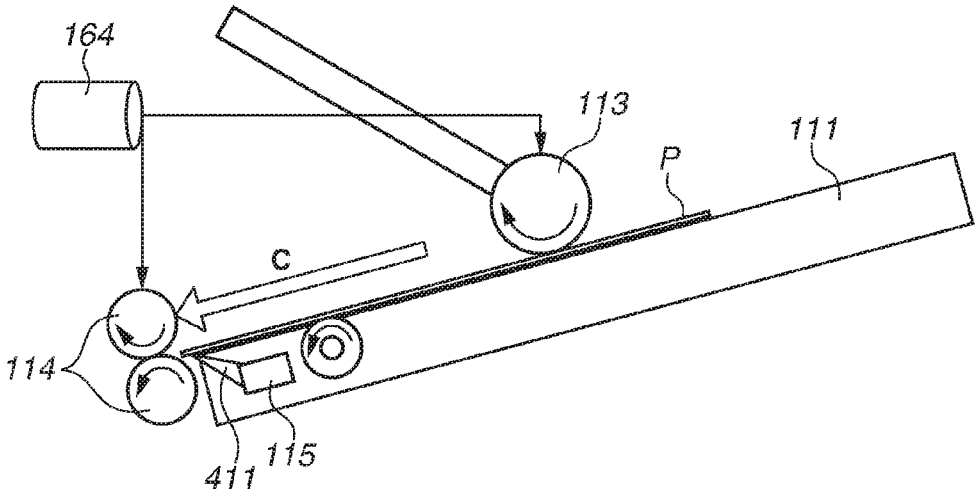
FIGS. 3A and 3B are a cross-sectional view and a top plan view of the neighborhood of a sheet feed tray, respectively.

First, a configuration for detecting a sheet on the sheet feed tray 111 according to the present exemplary embodiment is described with reference to FIGS. 3A and 3B. FIG. 3A is a cross-sectional view of the neighborhood of the sheet feed tray 111. A sheet presence/absence flag 411 is arranged at the end portion of the sheet feed tray 111 on the side at which the sheet feed rollers 114 are located. In the present exemplary embodiment, the sheet presence/absence flag 411 is mounted at the middle portion in the width direction perpendicular to the conveyance direction of the sheet P. The sheet presence/absence sensor 115 is, for example, a flag-type sensor. As illustrated in FIG. 3A, when the sheet P is placed on the sheet feed tray 111, the sheet presence/absence flag 411 is pushed by the leading edge portion of the sheet P in the conveyance direction, so that the sheet presence/absence flag 411 blocks light from entering the sheet presence/absence sensor 115. At this time, the sheet presence/absence sensor 115 outputs an ON signal.

On the other hand, when there is no sheet P on the sheet feed tray 111, the sheet presence/absence flag 411 does not block light from entering the sheet presence/absence sensor 115. At this time, the sheet presence/absence sensor 115 outputs an OFF signal. With this configuration, the CPU 301 is configured to be able to detect the presence or absence of a sheet on the sheet feed tray 111. When a sheet P is placed on the sheet feed tray 111, the CPU 301 displays a sheet size selection screen on the operation unit 330. Displaying on the operation unit 330 is described below. Furthermore, when the sheet feed pickup roller 113 is in a state of being in contact with the sheet P, the CPU 301 drives the sheet conveyance motor 164. With this, the sheet feed pickup roller 113 and the sheet feed rollers 114 are rotated in the respective directions indicated by arrows in FIG. 3A, so that the sheet P is fed and conveyed in an unfilled arrow direction C illustrated in FIG. 3A. The CPU 301 performs control over the sheet presence/absence sensor 115 and the sheet conveyance motor 164 via the sheet conveyance unit 270 illustrated in FIG. 2.

Figure 3B:
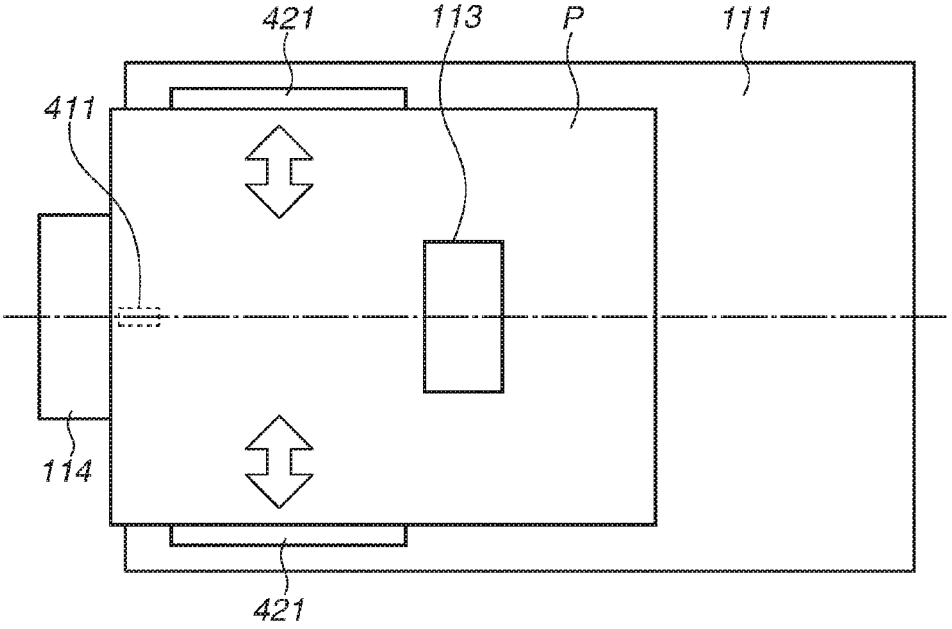

FIG. 3B is a projection view as viewed from above the sheet feed tray 111, in which the middle position in the width direction perpendicular to the conveyance direction is indicated by a dashed-dotted line. As illustrated in FIG. 3B, side regulating plates 421, which are configured to be movable in unfilled arrow directions (along with the width direction perpendicular to the conveyance direction), are arranged on the sheet feed tray 111. The side regulating plates 421 interpose the sheet P between the far side (the upper side in FIG. 3B) and the near side (the lower side in FIG. 3B). With this, the side regulating plates 421 are configured to prevent skewing of the sheet P placed on the sheet feed tray 111, and to match the middle position in the width direction of the sheet P with the middle position of the sheet feed tray 111 in the depth direction in FIG. 1. With the above-described configuration, image formation can be performed at a correct position on the sheet P fed from the sheet feed tray 111. Moreover, the positions of the side regulating plates 421 are detected by position sensors (not illustrated). To determine the size of the sheet. P, the CPU 301 detects the length of the sheet P in the width direction. (also serving as the width of the sheet P) based on the positions of the side regulating plates 421. In other words, the positions of the side regulating plates 421 serve as information used to determine the size of a sheet, and the CPU 301 functions as a size detection unit configured to detect information used to determine the size of the sheet. P stacked on the sheet feed tray 111. Furthermore, the CPU 301 changes a display content of the sheet size selection screen displayed on the operation unit 330 based on the detected information. Displaying on the operation unit 330 is described below.

[Description of Operation Unit 330]

[Determination of Size of Sheet]

Figure 4A:
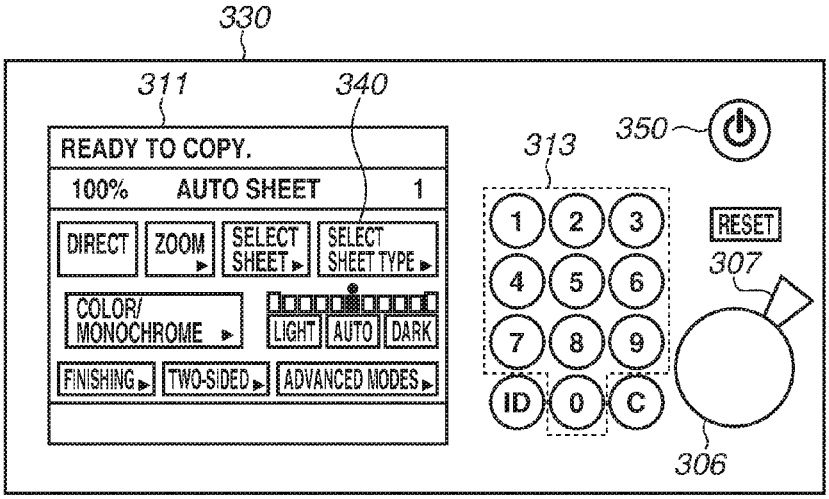
FIGS. 4A, 4B, 4C, 4D, and 4E are schematic diagrams of an operation unit.

FIG. 4A is a front view of the operation unit 330 according to the present exemplary embodiment. The operation unit 330 is provided with, for example, a start key 306, which is used to start a copy operation, a stop key 307, which is used to stop the copy operation, and a numeric keypad 313, which is used to set, for example, the number of copies. Furthermore, a display unit 311, which is composed of a touch panel, is arranged at the left-half portion of the operation unit 330, and software keys are displayed on the screen of the display unit 311. Moreover, the CPU 301 performs control for the printing preparatory operation according to an operation on, for example, the numeric keypad 313, which is used to set, for example, the number of copies. Additionally, the operation unit 330 is further provided with a power saving button 350, which is used to shift the image forming apparatus from a normal power mode to a power saving mode.

Figure 4B:
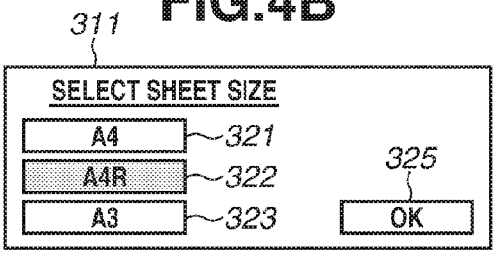
Figure 4C:
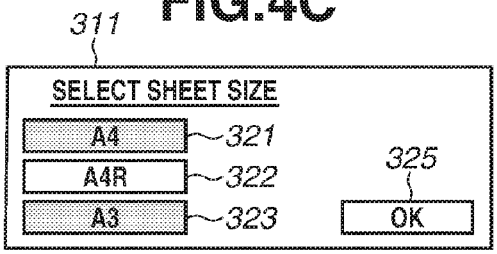

FIGS. 4B and 4C each illustrate the sheet size selection screen displayed on the display unit 311 when the sheet P is placed on the sheet feed tray 111. As mentioned above, the CPU 301 determines the display content of the display unit 311 based on the detected positions of the side regulating plates 421 (information indicating the width of the sheet P). The CPU 301 displays, on the display unit 311, candidates of the size of the sheet P stacked on the sheet feed tray 111 based on the information used to determine the size of the sheet P. On the display unit 311, there are displayed an A4 button 321, an A4R button 322, an A3 button 323, and an OK button 325, which represent respective sheet sizes. When the OK button 325 is pressed with any one of the A4 button 321 to the A3 button 323 selected, the sheet size is determined and the selected sheet size is stored into the RAM 303. The A4 button 321, the A4R button 322, the A3 button 323, and the OK button 325 function as a selection unit configured to select the size of the sheet P from among the sheet size candidates displayed on the display unit 311. In response to the size of the sheet P being selected from among the candidates displayed on the display unit 311 with these buttons pressed, the size of the sheet P stacked on the sheet feed tray 111 is determined. Therefore, the operation unit 330 functions as a size determiner configured to determine the size of a sheet.

FIG. 4B illustrates a screen displayed on the display unit 311 when the CPU 301 detects that the size of the sheet placed on the sheet feed tray 111 is A4 or A3 based on the positions of the above-mentioned side regulating plates 421. In this case, as illustrated in FIG. 4B, the A4 button 321 and the A3 button 323 are in a state of being selectable, and the A4R button 322 is excluded from operation objects and is in a state of being unselectable by being displayed in a grayout manner. On the other hand, FIG. 4C illustrates a screen displayed on the display unit 311 when the CPU 301 detects that the size of the sheet placed on the sheet feed tray 111 is A4R based on the positions of the above-mentioned side regulating plates 421, In this case, as illustrated in FIG. 4C, the A4R button 322 is in a state of being selectable, and the A4 button 321 and the A3 button 323 are excluded from operation objects and are in a state of being unselectable by being displayed in a grayout manner.

After the sheet size is determined using the sheet size selection screen on the display unit 311, when the CPU 301 determines that there is no sheet P on the sheet feed tray 111 based on a result of detection by the sheet presence/absence sensor 115, the sheet size becomes undetermined. Then, information indicating that the sheet size is undetermined is stored into the RAM 303. Such a situation corresponds to a case where, for example, after the sheet size is determined, all of the sheets P are extracted from the sheet feed tray 111. When, after that, a sheet or sheets P are placed on the sheet feed tray 111, the sheet size selection screen is displayed again on the display unit 311. In the image forming apparatus according to the present exemplary embodiment, a printing operation does not start until the sheet size is determined.

Figure 4D:
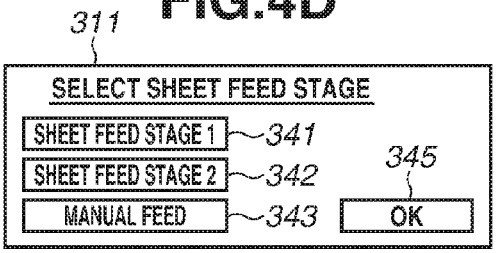
Figure 4E:
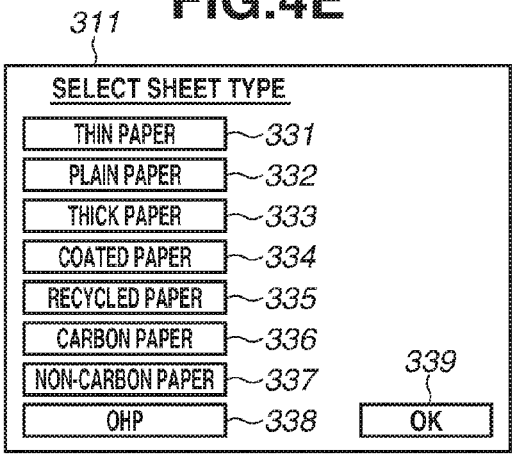

FIGS. 4D and 4E each illustrate a screen displayed on the display unit 311, which is used to select the type of the sheet P set on the sheet feed tray 111. When a sheet type select button 340 (referring to FIG. 4A) displayed on the display unit 311 is pressed, a sheet feed stage selection screen illustrated in FIG. 4D is displayed. The sheet feed stage selection screen is provided with a sheet feed stage 1 button 341, a sheet feed stage 2 button 342, and a manual feed button 343. When any one of the sheet feed stage 1 button 341, the sheet feed stage 2 button 342, and the manual feed button 343 is pressed and an OK button 345 is then pressed, a sheet type selection screen, which is used to select a sheet type, illustrated in FIG. 4E is displayed on the display unit 311.

The sheet type selection screen illustrated in FIG. 4E is provided with a thin paper button 331, a plain paper button 332, a thick paper button 333, a coated paper button 334, a recycled paper button 335, a carbon paper button 336, a non-carbon paper button 337, and an overhead projector (OHP) button 338. When any one of the buttons 331 to 338 is pressed and an OK button 339 is then pressed, the previously selected sheet feed stage and the sheet type are determined, and the sheet feed stage and the sheet type are stored into the RAM 303 while being associated with each other. In this way, in the present exemplary embodiment, a method of selecting a sheet type for each sheet feed stage in advance is employed. For example, after the OK button 325 illustrated in FIGS. 4B and 4C is pressed, the sheet type selection screen illustrated in FIG. 4E can be displayed, so that the sheet type can be selected each time the sheet size is selected. Additionally, in the present exemplary embodiment, the default sheet type is set to plain paper.

The buttons 331 to 339 function as a selection unit configured to select the type of the sheet P from among the candidates of sheet types displayed on the display unit 311. In response to the type of the sheet P being determined with these buttons pressed, the type of the sheet P stacked on the sheet feed tray 111 is set. Therefore, the operation unit 330 functions as a sheet type setter configured to set the type of a sheet.

[Description of Lifting and Lowering of Sheet Feed Pickup Roller]

Figure 5A:
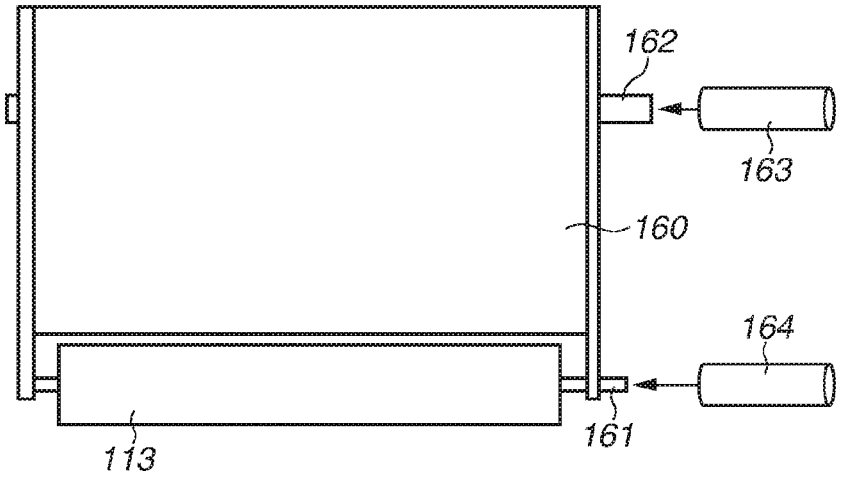
FIGS. 5A, 5B, and 5C are diagrams used to illustrate lifting and lowering operations of a sheet feed pickup roller.
Figure 5B:
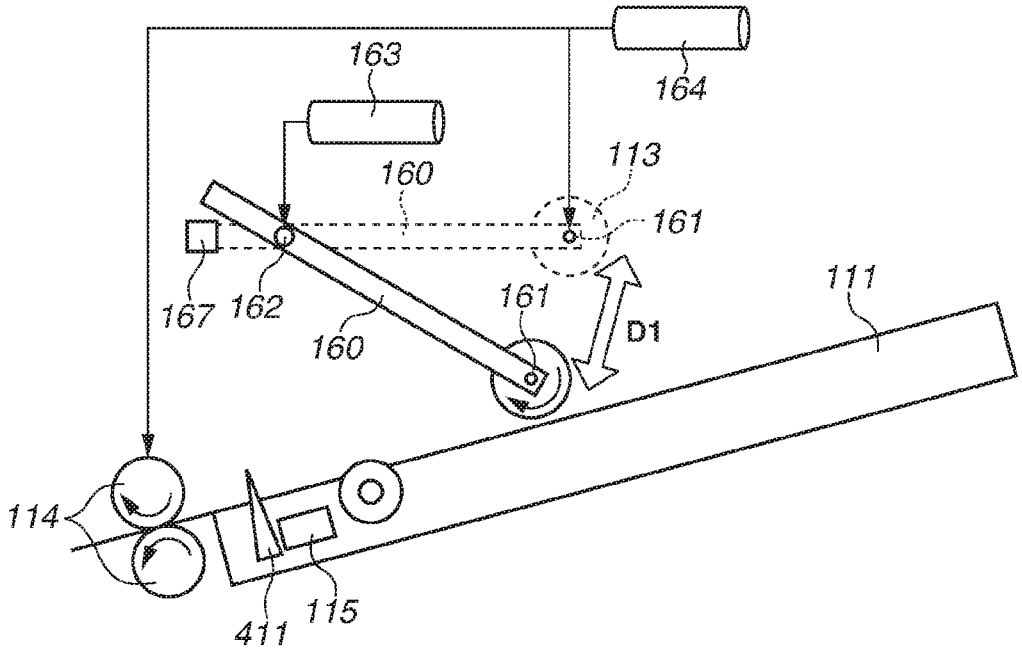
Figure 5C:
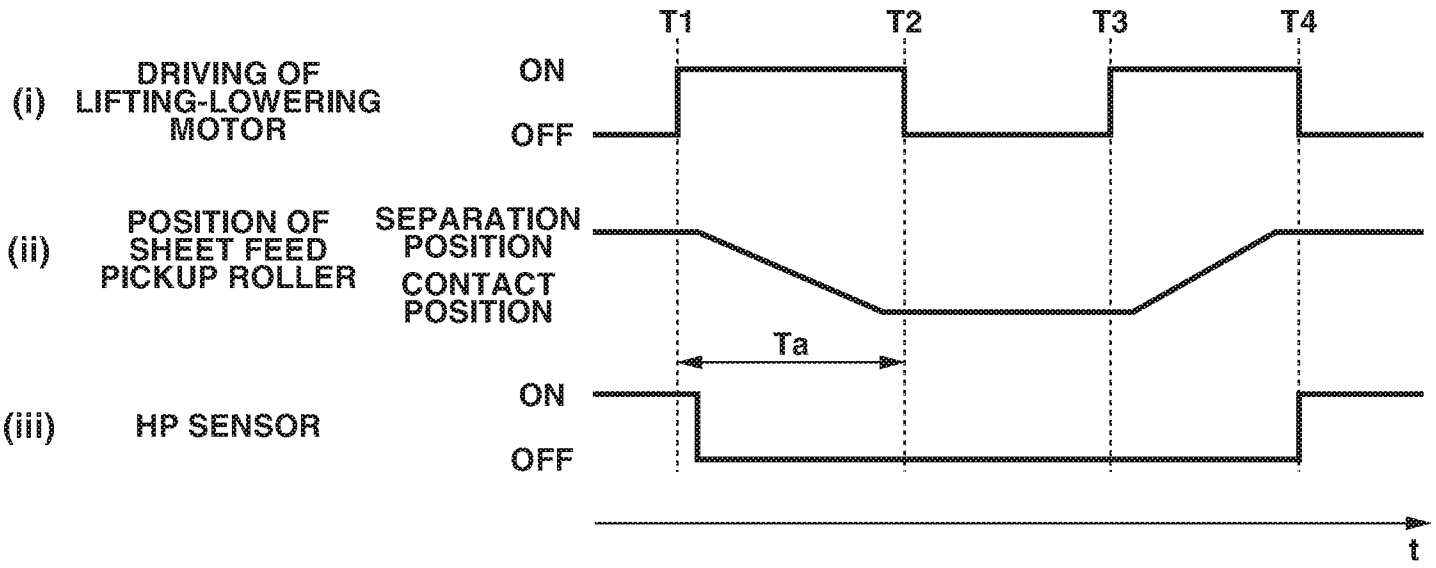

FIGS. 5A, 5B, and 5C are diagrams used to illustrate lifting and lowering operations of the sheet feed pickup roller 113 according to the present exemplary embodiment. FIG. 5A is a projection view illustrating the sheet feed pickup roller 113 and a sheet feed arm 160, which supports the sheet feed pickup roller 113, in the manual feed portion as viewed from above. The sheet feed pickup roller 113 is supported by the sheet feed arm 160 via a sheet feed pickup roller shaft 161. A sheet feed arm shaft 162 is fixed to the sheet feed arm 160 and is configured to receive driving of the lifting-lowering motor 163 via a cam (not illustrated).

Next, lifting and lowering operations of the sheet feed pickup roller 113 are described with reference to FIG. 5B. FIG. 5B is a cross-sectional view of the manual feed portion, in which the contact position of the sheet feed pickup roller 113 is indicated by a solid line and the separation position of the sheet feed pickup roller 113 is indicated by a dashed line. When the lifting-lowering motor 163 rotates in a predetermined direction, driving of the lifting-lowering motor 163 is transmitted to the sheet feed arm shaft 162 via a cam (not illustrated). With this, the sheet feed arm 160 and the sheet feed pickup roller 113 reciprocate between the contact position and the separation position within a predetermined angle range. The Lifting-lowering motor 163 functions as a change unit configured to change the positions of the sheet feed arm 160 and the sheet feed pickup roller 113. The CPU 301 functions as a controller configured to control the lifting-lowering motor 163 in such a way as to switch between the first state, in which the sheet feed pickup roller 113 is in contact with a sheet, and the second state, in which the sheet feed pickup roller 113 is separate from a sheet. More specifically, the sheet feed arm shaft 162 is fixed to the sheet feed arm 160, and the sheet feed arm 160 performs lifting and lowering operations according to a rotary operation around the sheet feed arm shaft 162. The sheet feed pickup roller 113 lifts and lowers as indicated by a double-headed arrow D1 in conjunction with the lifting and lowering operations of the sheet feed arm 160. A home position sensor (hereinafter referred to as an "HP sensor") 167 for the sheet feed pickup roller 113 is, for example, an optical sensor. The HP sensor 167 is configured to be shielded from light by the sheet feed arm 160 when the sheet feed pickup roller 113 is in the above-mentioned separation position (also serving as an initial position), in which the sheet feed pickup roller 113 is in the position most separate from the sheet feed tray 111 within a predetermined movable range.

FIG. 5C is a timing chart related to lifting and lowering of the sheet feed pickup roller 113. More specifically, line (i) in FIG. 5C represents a driving state of the lifting-lowering motor 163, in which the lifting-lowering motor 163 being driven is indicated by the high level (ON), and the lifting-lowering motor 163 not being driven is indicated by the low level (OFF). Line (ii) in FIG. 5C represents the position of the sheet feed pickup roller 113, in which the above-mentioned separation position and contact position are indicated. Line (iii) in FIG. 5C represents the state of the HP sensor 167, in which the HP sensor 167 being shielded from light is indicated by the high level (ON), and the HP sensor 167 not being shielded from light is indicated by the low level (OFF). In each line, the abscissa axis represents time t.

For example, when the sheet size transitions from an undetermined state to a determined state and a condition described below is satisfied, if the sheet feed pickup roller 113 is in the separation position (the HP sensor 167 is ON), the CPU 301 starts driving of the lifting-lowering motor 163 at timing T1. When driving of the lifting-lowering motor 163 is started, the sheet feed pickup roller 113 starts to lower from the separation position, and the HP sensor 167 transitions from the light-shielded state to the non-light-shielded state. At timing T2 when a predetermined time Ta has elapsed from the timing T1, the CPU 301 determines that the sheet feed pickup roller 113 has lowered to the contact position. The CPU 301 stops driving of the lifting-lowering motor 163 and keeps the position of the sheet feed pickup roller 113 in the contact position. More specifically, when determining that the sheet feed pickup roller 113 has lowered to the contact position, the CPU 301 stores such information into the RAM 303. Here, in the present exemplary embodiment, the CPU 301 determines that the sheet feed pickup roller 113 has moved to the contact position by detecting that the predetermined time Ta has elapsed from the start of driving of the lifting-lowering motor 163. However, for example, a sensor that detects that the sheet feed pickup roller 113 has moved to the contact position can be additionally provided.

Before receiving a printing operation start instruction, the CPU 301 waits for reception of the printing operation start instruction while keeping the sheet feed pickup roller 113 in the contact position. This shortens a first copy out time (FCOT) as much as the predetermined time Ta (=500 ms) as compared with a case where the sheet feed pickup roller 113 is moved from the separation position to the contact position after reception of the printing operation start instruction. The FCCT as used herein refers to a time from when the start key 306, which is used to start a copy operation, is pressed to when the first sheet P is discharged. The predetermined time Ta is a time required to move the sheet feed pickup roller 113 from the separation position to the contact position, and a value thereof previously determined by, for example, measurement is stored in the ROM 302. Moreover, the predetermined time Ta is determined in consideration of, for example, variations occurring during a time from when the CPU 301 outputs a signal for starting or stopping driving of the lifting-lowering motor 163 to when the lifting or lowering operation of the sheet feed pickup roller 113 is actually started or stopped.

Next, the CPU 301 starts driving of the lifting-lowering motor 163 again at timing T3 when feeding of the last sheet in the printing operation (the last sheet in a job) is completed. With this, the sheet feed pickup roller 113 starts to lift from the contact position. At timing T4 when detecting that the HP sensor 167 has been shielded from light, the CPU 301 determines that the sheet feed pickup roller 113 has lifted to the separation position. Then, the CPU 301 stops driving of the lifting-lowering motor 163 and keeps the position of the sheet feed pickup roller 113 in the separation position. However, the above-described configurations and conditions for lifting and lowering control of the lifting-lowering motor 163, the sheet feed pickup roller 113, and the HP sensor 167 are merely examples, and the present invention is not limited to such configurations. Moreover, while, in the present exemplary embodiment, the sheet feed pickup roller 113 is configured to lift and lower so as to bring the sheet feed pickup roller 113 and the sheet P into a contact state and a separation state, the sheet feed tray 111 can be configured to lift and lower with the position of the sheet feed pickup roller 113 fixed. In this case, for example, a motor for causing the sheet feed tray 111 to lift and lower functions as a changing unit.

[Lifting and Lowering Operations of Sheet Feed Pickup Roller]

The present exemplary embodiment is characterized in that when the sheet size on the sheet feed tray 111 is determined and a condition described below is satisfied, the sheet feed pickup roller 113 is moved. In advance to the contact position before reception of a printing operation start instruction. This enables immediately feeding a sheet when a printing operation starts. Therefore, the FCOT can be shortened as much as a time required to bring the sheet feed pickup roller 113 and the sheet into a contact state as compared with a configuration. In which the sheet feed pickup roller 113 is moved to the contact position after reception of the printing operation start instruction.

As mentioned in the foregoing, when a sheet or sheets are set on the sheet feed tray 111, the CPU 301 first detects the presence of a sheet or sheets using the sheet presence/absence sensor 115, and then allows the user to select a sheet size on the sheet size selection screen displayed on the operation unit 330 to determine the sheet size. The reason why one of conditions for moving the sheet feed pickup roller 113 to the contact position is "the sheet size having been determined" is described as follows.

When the sheet feed pickup roller 113 is in the contact position, the sheet feed pickup roller 113 is pressing the sheet toward the sheet feed tray 111 to some extent so as to feed a sheet on the sheet feed tray 111. In such a situation, in a case where the user attempts to extract all of the sheets on the sheet feed tray 111 and place a new sheet or sheets on the sheet feed tray 111, it is possible to extract the sheets from the sheet feed tray 111, but it is difficult to insert a sheet bundle between the sheet feed tray 111 and the sheet feed pickup roller 113. Therefore, in the state in which the sheet feed pickup roller 113 is in the contact position irrespective of conditions of the image forming apparatus or sheets on the sheet feed tray 111, usability decreases.

Furthermore, even when the sheet feed pickup roller 113 is moved to the contact position at timing immediately after the user sets a sheet or sheets on the sheet feed tray 111, it may become impossible for the user to move the side regulating plates 421 to match the sheet position. Therefore, even when the CPU 301 detects the presence of a sheet or sheets using the sheet presence/absence sensor 115 and moves the sheet feed pickup roller 113 to the contact position before the sheet size is determined, usability decreases.

As described with reference to FIGS. 3A and 3B and FIGS. 4A to 4E, the CPU 301 detects the size of the sheet P (the width of the sheet P) based on the positions of the side regulating plates 421, and limits the display content of the sheet size selection screen displayed on the operation unit 330 based on the detected size. Therefore, in the stage in which the user determines the sheet size via the operation unit 330, the positions of the side regulating plates 421 are likely to have already been correctly set. With this, after the sheet size is determined, even when the sheet feed pickup roller 113 is moved to the contact position, the FCOT can be shortened without any decrease in usability.

Furthermore, the method for determining the sheet size in the present exemplary embodiment is merely an example, and is not limited to a configuration using the side regulating plates 421 as in the present exemplary embodiment. For example, instead of a configuration using the side regulating plates 421, there is a configuration of detecting the sheet size by capturing the image of a sheet on the sheet feed tray 111 with, for example, an imaging apparatus. In the case of an image forming apparatus having such a configuration, even if a sheet is obliquely set on the sheet feed tray 111, image formation is performed according to the angle of setting of the sheet in such a way that a toner image is transferred onto a predetermined position on the sheet. Even in such a configuration, it can be considered that the size of the sheet is determined as a size detected by a predetermined method.

[Processing for Determining State of Image Forming Apparatus]

Figure 6:
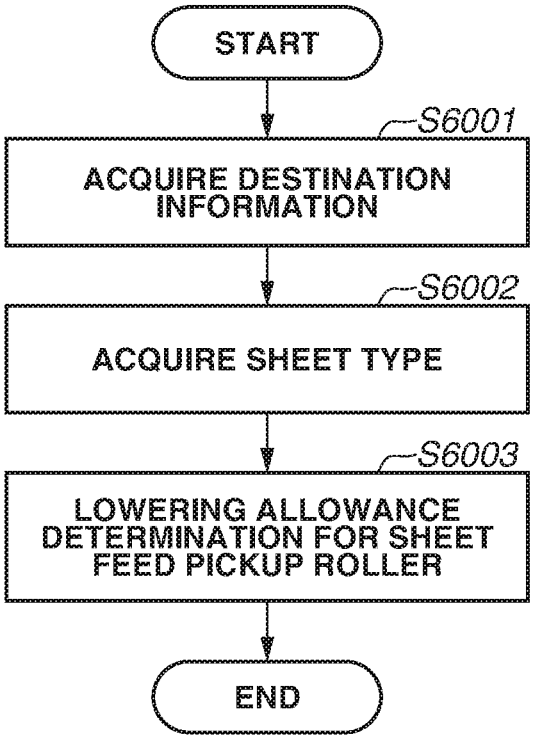
FIG. 6 is a flowchart illustrating processing for determining whether to allow a lowering operation of the sheet feed pickup roller.

FIG. 6 is a flowchart illustrating processing performed by the CPU 301 to determine the state of the image forming apparatus. The processing illustrated in FIG. 6 is processing performed by the CPU 301, for example, when the sheet size has been determined, and the determination of the sheet size is described below. In step S6001, the CPU acquires destination information about the installment of an image forming apparatus. The destination information is information about a country or region in which the image forming apparatus is to be used, and is usually a value that is set in advance at the factory at the time of shipment of the image forming apparatus and is stored in, example, the ROM 302. In the present exemplary embodiment, the CPU 301 reads and acquires the destination information on the image forming apparatus from, for example, the ROM 302. In step S6002, the CPU 301 acquires information about the sheet type of the targeted sheet feed stage, which has been selected as described with reference to FIGS. 4D and 4E. In step S6003, the CPU 301 makes determination whether to perform a lowering operation of the sheet feed pickup roller 113 (hereinafter referred to as a "lowering allowance determination"), and stores information indicating "allowed" or "not allowed", which is a result of the lowering allowance determination, into, for example, the RAM 303. In the present exemplary embodiment, the CPU 301 performs the lowering allowance determination of the sheet feed pickup roller 113 using Table 1 based on the information acquired in steps S6001 and S6002. Table 1 contains a description of information indicating whether the lowering operation of the sheet feed pickup roller 113 is "allowed" or "not allowed" according to a combination of the sheet type and the destination information.

TABLE 1

| | Destination A | Destination B | Destination C |
|---|---|---|---|
| Thin Paper | Allowed | Not Allowed | Not Allowed |
| Plain Paper | Allowed | Allowed | Allowed |
| Thick Paper | Allowed | Allowed | Not Allowed |
| Coated Paper | Not Allowed | Not Allowed | Not Allowed |
| Recycled Paper | Allowed | Allowed | Not Allowed |
| Carbon Paper | Not Allowed | Not Allowed | Not Allowed |
| Non-Carbon Paper | Not Allowed | Not Allowed | Not Allowed |
| OHP | Allowed | Not Allowed | Not Allowed |

The first column in Table 1 indicates the types of the sheet P (for example, thin paper or plain paper), and corresponds to the buttons on the sheet type selection screen illustrated in FIG. 4E. The second column to the fourth column in Table 1 indicate respective results of the lowering allowance determination for the destination A, destination B, and destination C, which are different pieces of destination information. As shown in Table 1, the reason why the lowering allowance of the sheet feed pickup roller 113 is changed according to destinations of the image forming apparatus is that even different sheets are actually distributed in the market as the same type of sheet P according to destinations of the image forming apparatus.

For example, in the case of the present exemplary embodiment, recycled paper mainly distributed in the destination. A and the destination B is supposed to include the one in which the blending amount of a loading material contained in paper is small. On the other hand, recycled paper mainly distributed in the destination C is supposed to include the one which the blending amount of a loading material contained in paper is large. Therefore, in the case of an image forming apparatus directed to the destination C, in a condition in which recycled paper is selected, the lowering operation of the sheet feed pickup roller 113 is not performed. Moreover, with regard to paper that is likely to soil the sheet feed pickup roller 113, such as carbon paper or non-carbon paper, the lowering operation of the sheet feed pickup roller 113 is not performed (not allowed) irrespective of the destination information, in other words, in any destination. The CPU 301 determines whether the sheet feed pickup roller 113 is allowed to change from the separation position to the contact position according to the sheet type and the destination information on the image forming apparatus, and controls the lifting-lowering motor 163 according to result of the determination.

[Processing for Controlling Sheet Feed Pickup Roller (at the Time of Detection of Setting of Sheet)]

Figure 7A:
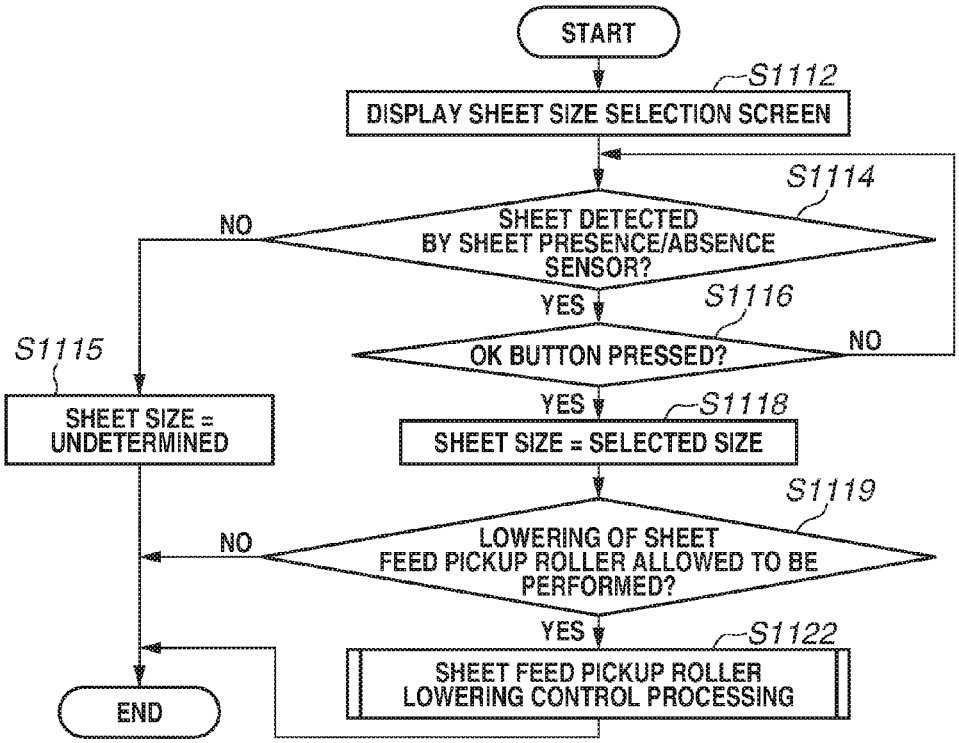
FIGS. 7A and 7B are flowcharts illustrating processing for determining states of the image forming apparatus.
Figure 7B:
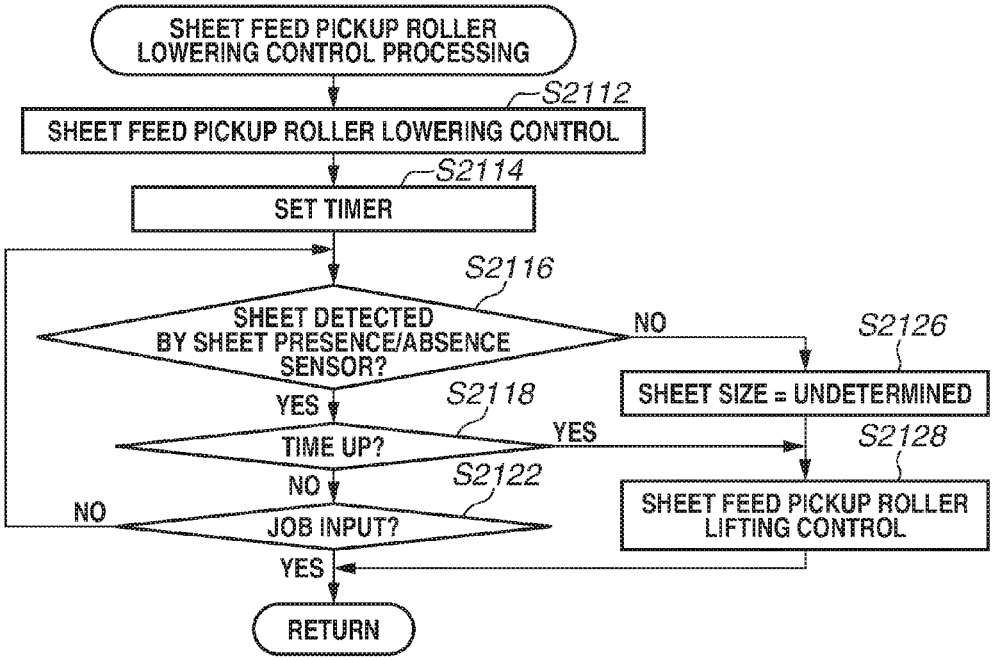

FIGS. 7A and 7B are flowcharts illustrating control performed when the sheet size has been determined, which characterizes the present exemplary embodiment. The CPU 301 performs control processing illustrated in FIGS. 7A and 7B when detecting that a sheet or sheets have been set on the sheet feed tray 111. First, processing illustrated in FIG. 7A is described. In a case where information about the sheet size stored in the RAM 303 is information indicating "size undetermined", when the sheet presence/absence sensor 115 detects the presence of a sheet, the CPU 301 determines that a sheet or sheets have been placed on the sheet feed tray 111. Then, the CPU 301, when determining that a sheet or sheets have been placed on the sheet feed tray 111, performs processing in step S1112 and subsequent steps illustrated in FIG. 7A. Hereinafter, the information about the sheet size is referred to simply as "sheet size information", and the information indicating "size undetermined" is referred to simply as "size undetermined".

In step S1112, the CPU 301 displays a sheet size selection screen, such as that illustrated in FIG. 4B or 4C, on the operation unit 330 so as to prompt the user to select the sheet size. In step S1114, the CPU 301, while displaying the sheet size selection screen on the operation unit 330, determines whether the sheet presence/absence sensor 115 detects a sheet. If, in step S1114, the CPU 301 determines that the sheet presence/absence sensor 115 detects no sheet (the absence of a sheet) (NO in step S1114), then in step S1115, the CPU 301 sets the sheet size information stored in the RAM 303 to "size undetermined" and ends the processing.

On the other hand, if in step S1114, the CPU 301 determines that the sheet presence/absence sensor 115 detects a sheet (the presence of a sheet) (YES in step S1114), in other words, if the state of the presence of a sheet is maintained even after the sheet size selection screen is displayed on the operation unit 330, the CPU 301 advances the processing to step S1116. In step S1116, the CPU 301 determines whether the OK button 325 in the sheet size selection screen on the operation unit 330 has been pressed. If, in step S1116, the CPU 301 determines that the OK button 325 is not pressed (NO in step S1116), the CPU 301 returns the processing to step S1114. If, in step S1116, the CPU 301 determines that the OK button 325 has been pressed (YES in step S1116), the CPU 301 determines that the sheet size on the sheet feed tray 111 has been determined and advances the processing to step S1118. Furthermore, after the OK button 325 illustrated in FIG. 4B or 4C is pressed, the CPU 301 displays the sheet type selection screen illustrated in FIG. 4E to allow the user to set the type of the sheet. P the sheet size of which has been determined. The CPU 301 stores the set type of the sheet P on the sheet feed tray 111 into the RAM 303.

In step S1118, the CPU 301 stores the sheet size (selected size) selected via the operation unit 330 as sheet size information into the RAM 303 in such a manner that when, for example, the A4 button 321 is selected on the sheet size selection screen of the operation unit 330, the CPU 301 stores "A4 size" into the RAM 303. Furthermore, the CPU 301 performs processing for the lowering allowance determination for the sheet feed pickup roller 113 illustrated in FIG. 6. More specifically, the CPU 301 refers to Table 1 according to the destination information on the image forming apparatus and the sheet type, and stores a result of the lowering allowance determination for the sheet feed pickup roller 113 into the RAM 303.

In step S1119, the CPU 301 reads out the result of the lowering allowance determination for the sheet feed pickup roller 113 described with reference to FIG. 6 from the RAM 303, and determines whether the result of the lowering allowance determination indicates "allowed". More specifically, the CPU 301 determines whether the lowering operation of the sheet feed pickup roller 113 is allowed to be performed according to the destination information on the image forming apparatus and the sheet type. For example, in a case where the destination information acquired in step S6001 illustrated in FIG. 6 indicates "destination. A" and the sheet type acquired in step S6002 indicates "coated paper", information indicating "not allowed" is stored in the RAM 303 (referring to Table 1). Moreover, in a case where the destination information acquired in step S6001 illustrated in FIG. 6 indicates "destination C" and the sheet type acquired in step S6002 indicates "plain paper", information indicating "allowed" is stored in the RAM 303 (referring to Table 1).

If, in step S1119, the CPU 301 determines that the result of the lowering allowance determination is "allowed" (YES in step S1119), the CPU 301 advances the processing to step S1122. In step S1122, the CPU 301 performs sheet feed pickup roller lowering processing, which is described below, so as to move the sheet feed pickup roller 113 to the contact position. If, in step S1119, the CPU 301 determines that the result of the lowering allowance determination is "not allowed" (NC) in step S1119), the CPU 301 ends the processing without performing the lowering processing for the sheet feed pickup roller 113.

[Sheet Feed Pickup Roller Lowering Processing]

FIG. 7B is a flowchart illustrating sheet feed pickup roller lowering processing performed in step S1122 illustrated in FIG. 7A. When the sheet size is determined and the result of the lowering allowance determination is "allowed", the CPU 301 performs lowering processing to move the sheet feed pickup roller 113 to the contact position even if a printing start instruction is not received. Moreover, the printing start instruction can be received, for example, when the start key 306 of the operation unit 330 is pressed, or can be received from an external apparatus, such as the computer 283, via a network. In step S2112, the CPU 301 performs sheet feed pickup roller lowering control to drive the lifting-lowering motor 163 only for the time Ta, as described with reference to FIG. 5C. In step S2114, the CPU 301 performs timer setting for determining the lapse of a predetermined time, for example, 30 seconds, on the timer 291 so as to prevent the sheet feed pickup roller 113 from being left in the contact position for a long time. If the sheet feed pickup roller 113 is left in contact with a sheet for a long time, the trace of the sheet feed pickup roller 113 may remain on the uppermost sheet of a sheet stack stacked on the sheet feed tray 111. Therefore, in a case where a predetermined time has elapsed with the sheet feed pickup roller 113 kept in contact with a sheet, the CPU 301 moves the sheet feed pickup roller 113 to the separation position even if a printing start instruction is not input. Processing in step S2114 is processing for setting a predetermined time to the timer 291 to perform such a determination.

In step S2116, the CPU 301 determines whether the sheet presence/absence sensor 115 has detected a sheet. Processing in step S2116 is processing for dealing with a case where the user has extracted all of the sheets before the time set by the timer 291 is up after the sheet feed pickup roller 113 lowers. This is because, in a case where the user has extracted all of the sheets, it is necessary to perform control to cause the sheet feed pickup roller 113 to lift so as to enable the user to place a sheet or sheets again. If, in step S2116, the CPU 301 determines that the sheet presence/absence sensor 115 has detected no sheet (the absence of a sheet) (NO in step S2116), the CPU 301 advances the processing to step S2126, In step S2126, the CPU 301 sets the sheet size information, which is to be stored in the RAM 303, to "size undetermined" and stores such information into the RAM 303. In step S2128, the CPU 301 performs lifting control for the sheet feed pickup roller 113 to move the sheet feed pickup roller 113 to the separation position. This enables the user to place sheet or sheets on the sheet feed tray 111 again. More specifically, as described with reference to FIG. 5C, the CPU 301 drives the lifting-lowering motor 163 until the HP sensor 167 detects an edge that rises from OFF to ON.

If, in step S2116, the CPU 301 determines that the sheet presence/absence sensor 115 has detected a sheet (the presence of a sheet) (YES in step S2116), then in step S2118, the CPU 301 determines whether a predetermined time has elapsed by referring to the timer 291 (whether the time set by the timer 291 is up). If, in step S2118, the CPU 301 determines that the time set by the timer 291 is up (YES in step S2118), the CPU 301 advances the processing to step S2128. If, in step S2118, the CPU 301 determines that the time set by the timer 291 is not up (NO in step S2118), the CPU 301 advances the processing to step S2122. In step S2122, the CPU 301 determines whether an image forming job (hereinafter referred to simply as a "job") has been input according to the printing operation start instruction (whether the printing start instruction has been received), and when determining that the job has not been input (NO in step S2122), the CPU 301 returns the processing to step S2116. If, in step S2122, the CPU 301 determines that the job has been input. (YES in step S2122), the CPU 301 stops the timer 291, which has been started in step S2114, and ends the lowering processing for the sheet feed pickup roller 113.

[Control Processing for Sheet Feed Pickup Roller (for Example, at the Time of Power On)]

Figure 8:
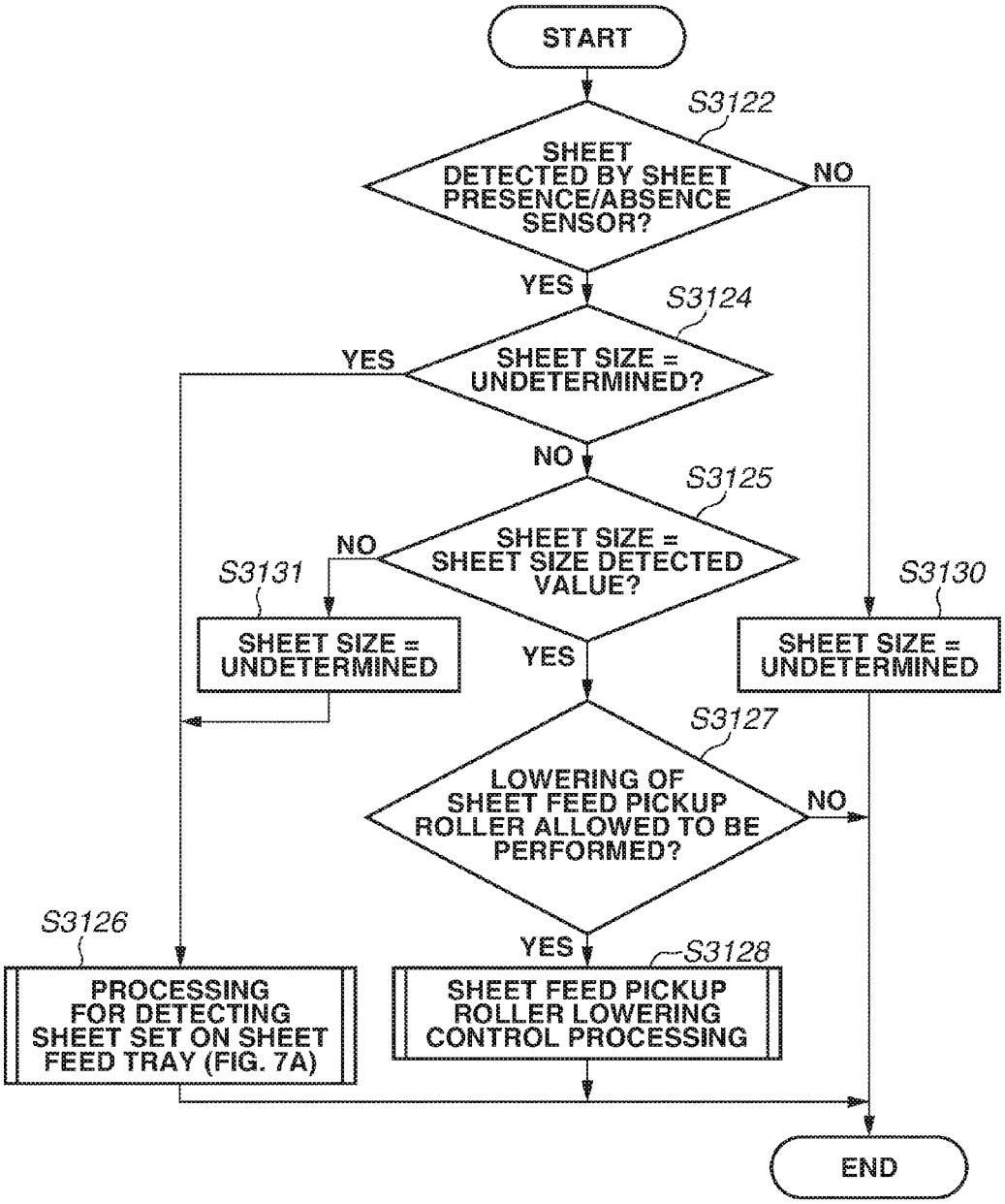
FIG. 8 is a flowchart illustrating processing for detecting setting of sheets on the sheet feed tray and processing for controlling lowering of the sheet feed pickup roller.

FIG. 8 is a flowchart illustrating control processing performed when the image forming apparatus is powered on or when the image forming apparatus returns from a power saving mode to a normal power mode. Moreover, the normal power mode refers to a mode in which the image forming apparatus operates in a normal power state, and the power saving mode refers to a mode in which the image forming apparatus operates in a power state lower than that in the normal power mode. For example, when the power saving button 350 of the operation unit 330 is pressed, the image forming apparatus shifts from the normal power mode to the power saving mode or returns from the power saving mode to the normal power mode. In step S3122, the CPU 301 determines whether the sheet presence/absence sensor 115 has detected a sheet, in step S3122, the CPU 301 determines that the sheet presence/absence sensor 115 has detected no sheet (the absence of a sheet) (NO in step S3122), the CPU 301 advances the processing to step S3130. In step S3130, the CPU 301 sets the sheet size information, which is to be stored in the RAM 303, to "size undetermined", and then ends the processing.

If, in step S3122, the CPU 301 determines that the sheet presence/absence sensor 115 has detected a sheet (the presence of a sheet) (YES in step S3122), the CPU 301 advances the processing to step S3124. In step S3124, the CPU 301 reads out the sheet size information stored in the RAM 303 and determines whether the read sheet size information indicates "size undetermined". The sheet size information stored in the RAM 303 as used herein refers to sheet size information obtained immediately before the image forming apparatus is last powered off or immediately before the image forming apparatus shifts to the power saving mode.

If, in step S3124, the CPU 301 determines that the sheet size information indicates "size undetermined" (YES in step S3124), the CPU 301 advances the processing to step S3126. In step S3126, the CPU 301 performs processing for detecting the presence of a sheet set on the sheet feed tray 111, as illustrated in FIG. 7A, so as to prompt the user to determine the sheet size on the sheet feed tray 111. If, in step S3124, the CPU 301 determines that the sheet size information stored in the RAM 303 does not indicate "size undetermined" (NO in step S3124), the CPU 301 advances the processing to step S3125. In step S3125, the CPU 301 determines whether the sheet size detected based on the positions of the side regulating plates 421 (mentioned as a "sheet size detected value" in FIG. 8) and the sheet size information stored in the RAM 303 coincide with each other.

If, in step S3125, the CPU 301 determines that the sheet size detected on the sheet feed tray 111 and the sheet size information stored in the RAM 303 coincide with each other (YES in step S3125), the CPU 301 advances the processing to step S3127. In step S3127, the CPU 301 reads out a result of the lowering allowance determination for the sheet feed pickup roller 113 from the RAM 303 and determines whether the result of the lowering allowance determination for the sheet feed pickup roller 113 indicates "allowed". In other words, the CPU 301 determines whether the lowering operation of the sheet feed pickup roller 113 is allowed to be performed according to the destination information on the image forming apparatus and the sheet type. If, in step S3127, the CPU 301 determines that the result of the lowering allowance determination indicates "allowed", in other words, the lowering operation of the sheet feed pickup roller 113 is allowed to be performed (YES in step S3127), the CPU 301 advances the processing to step S3128. In this case, a sheet or sheets of the same size as the size that was determined before the image forming apparatus was powered off or shifted to the power saving mode are likely to have been placed on the sheet feed tray 111. Therefore, the CPU 301 determines the sheet size without any change, and, in step S3128, performs lowering control for the sheet feed pickup roller 113 to move the sheet feed pickup roller 113 to the contact position as described with reference to FIG. 7B.

If, in step S3127, the CPU 301 determines that the result of the lowering allowance determination indicates "not allowed", in other words, the lowering operation of the sheet feed pickup roller 113 is not allowed to be performed (NO in step S3127), the CPU 301 ends the processing without performing the lowering processing for the sheet feed pickup roller 113.

If, in step S3125, the CPU 301 determines that the sheet size detected on the sheet feed tray 111 and the sheet size information stored in the RAM 303 do not coincide, with each other (NO in step S3125), the CPU 301 advances the processing to step S3131. In this case, there is a possibility that, during the power-off state or the power saving mode, all of the sheets on the sheet feed tray 111 may have been extracted and a sheet or sheets of another size have been placed thereon. In step S3131, the CPU 301 sets the sheet size information, which is to be stored in the RAM 303, to "size undetermined", and then advances the processing to step S3126. With the above-described control, even when a printing start request is made immediately after the return from the power saving mode, the size selection screen can be appropriately displayed while the FCOT is shortened.

Furthermore, not only when the image forming apparatus has been powered on or when the image forming apparatus has returned from the power saving mode to the normal power mode, but also before the image forming operation starts, the control processing illustrated in FIG. 8 can be performed when a sheet or sheets have been set on the sheet feed tray 111.

[Control Processing for Sheet Feed Pickup Roller for Printing Preparatory Operation]

Figure 9:
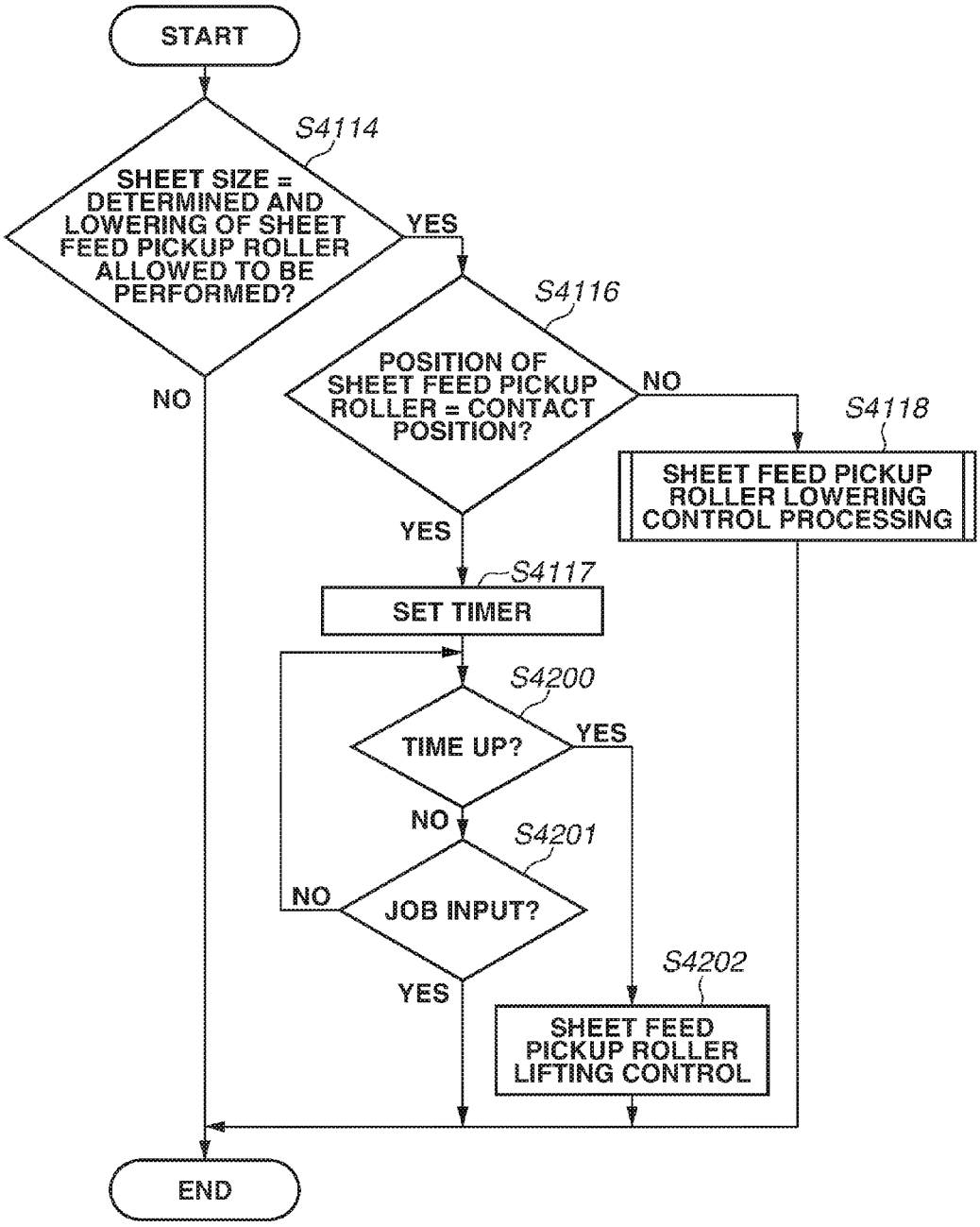

FIG. 9 is a flowchart illustrating control processing for a printing preparatory operation. The CPU 301 determines the presence or absence of an operation supposed to be directed to execution of image formation, such as opening and closing of the document pressure plate 56, placement of a document, or placement of a sheet or sheets on the sheet feed tray 111. When detecting the presence or an operation supposed to be directed to execution of image formation, the CPU 301 performs the following printing preparatory operation. Moreover, the CPU 301 also regards opening and closing of the document pressure plate 56 or placement of a document detected via the document feeding device control unit 480 or the image reader control unit 280 as an operation supposed to be directed to execution of image formation.

In step S4114, the CPU 301 reads out the sheet size information stored in the RAM 303. Furthermore, the CPU 301 reads out a result of the lowering allowance determination for the sheet feed pickup roller 113 from the RAM 303 and determines whether the result of the lowering allowance determination indicates "allowed".

If, in step S4114, the sheet size is undetermined, the result of the lowering allowance determination indicates "not allowed", or the sheet size is undetermined and the result of the lowering allowance determination indicates "not allowed" (NO in step S4114), the CPU 301 ends the control processing for the printing preparatory operation. In this case, as described with reference to FIGS. 7A and 7B, the CPU 301 monitors whether a sheet or sheets have been set on the sheet feed tray 111, and, when detecting that a sheet or sheets have been set, performs the processing illustrated in FIG. 7A. Then, when an operation supposed to be directed to execution of image formation is performed, the sheet size on the sheet feed tray 111 is determined, and the result of the lowering allowance determination for the sheet feed pickup roller 113 indicates "allowed", the CPU 301 performs the lowering control for the sheet feed pickup roller 113.

If, in step S4114, the sheet size is determined and the result of the lowering allowance determination indicates "allowed" (YES in step S4114), the CPU 301 advances the processing to step S4116. In step S4116, the CPU 301 determines whether the sheet feed pickup roller 113 is in the contact position. If, in step S4116, the CPU 301 determines that the sheet feed pickup roller 113 is in the contact position. (YES in step S4116), the CPU 301 advances the processing to step S4117. In step S4117, the CPU 301 sets the timer 291 again as with the processing in step S2114 described with reference to FIG. 7B. Since it can be considered that the printing preparatory operation being performed is likely to lead to a printing operation being started, the processing in step S4117 is performed to keep the sheet feed pickup roller 113 in the contact position. On the other hand, since, when a predetermined time has elapsed, a printing operation becomes unlikely to be started, the CPU 301 performs control to cause the sheet feed pickup roller 113 to lift.

In step S4200, the CPU 301 determines whether a predetermined time has elapsed by referring to the time 291 (whether the time set by the timer 291 is up). If, in step S4200, the CPU 301 determines that the time set by the timer 291 is up (YES in step S4200), the CPU 301 advances the processing to step S4202. In step S4202, the CPU 301 performs lifting control for the sheet feed pickup roller 113 to move the sheet feed pickup roller 113 to the separation position, and then ends the processing. More specifically, as described with reference to FIG. 5C, the CPU 301 drives the lifting-lowering motor 163 until the HP sensor 167 detects an edge that rises from OFF to ON. This enables preventing the trace of the sheet feed pickup roller 113 from remaining on the sheet. In this case, when the sheet size is determined, if it is determined that an operation supposed to be directed to execution of image formation has been performed, the processing illustrated in FIG. 9 is performed.

If, in step S4200, the CPU 301 determines that the time set by the timer 291 is not yet up (NO in step S4200), the CPU 301 advances the processing to step S4201. In step S4201, the CPU 301 determines whether a job has been input according to a printing operation start instruction (whether a printing start instruction has been received), and, when determining that a job has not been input (NO in step S4201), returns the processing to step S4200. If, in step S4201, the CPU 301 determines that a job has been input (YES in step S4201), the CPU 301 stops the timer 291, which has started in step S4117, and ends the processing.

If, in step S4116, the CPU 301 determines that the sheet feed pickup roller 113 is not in the contact position (NO in step S4116), the CPU 301 advances the processing to step S4118. In step S4118, the CPU 301 performs lowering control for the sheet feed pickup roller 113, which is illustrated in FIG. 7B, to move the sheet feed pickup roller 113 to the contact position as with a case where the sheet size on the sheet feed tray 111 is determined, and ends the control processing. Furthermore, when the sheet feed pickup roller 113 is in the contact position, if the sheet feed cassette 153 or the sheet feed cassette 154 is selected, the sheet feed pickup roller lifting control is performed.

As described above, even in the printing preparatory operation control, the sheet feed pickup roller 113 can be moved to and kept in the contact position based on the state of the image forming apparatus and the determined information about the sheet size on the sheet feed tray 111. With this, even in a case where the lowering processing is unable to be performed according to the state of the image forming apparatus at the contact timing of the sheet feed pickup roller 113 described with reference to FIGS. 7A and 7B, the sheet feed pickup roller 113 can be moved to and kept in the contact position in advance of printing.

[Control Processing During Print Job]

Figure 10:
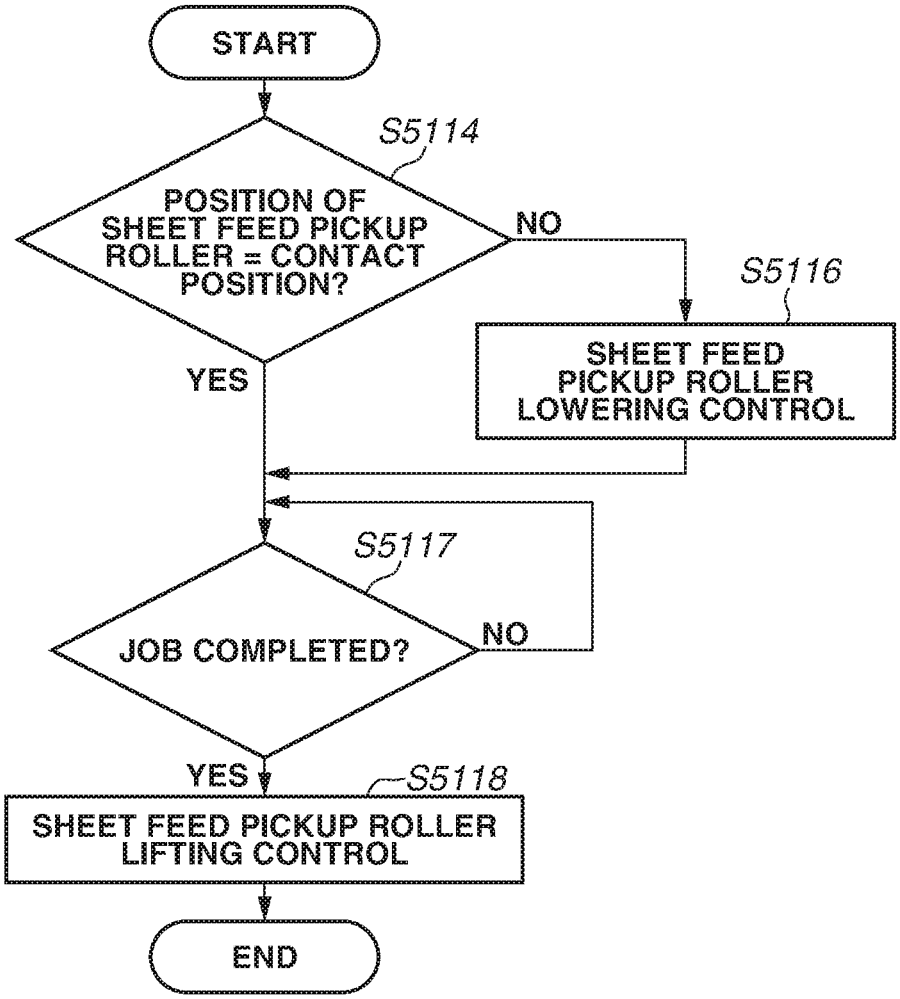
FIG. 10 is a flowchart illustrating processing for control performed when a printing preparatory operation is performed.

FIG. 10 is a flowchart illustrating control processing performed when a print job using a sheet or sheets stacked on the sheet feed tray 111 is started. When receiving a printing operation start instruction, the CPU 301 performs processing in step S5114 and subsequent steps. In step S5114, the CPU 301 determines whether the sheet feed pickup roller 113 is in the contact position. If, step S5114, the CPU 301 determines that the sheet feed pickup roller 113 is not in the contact position (NO in step S5114), the CPU 301 advances the processing to step S5116. In step S5116, the CPU 301 performs control to move the sheet feed pickup roller 113 to the contact position so as to feed the sheet P. As described thus far, the sheet feed pickup roller 113 is moved to the contact position at timing of the printing preparatory operation described with reference to FIG. 9. Therefore, usually, processing in step S5116 is not performed. The processing in step S5116 is processed, for example, when a print job is started after the lapse of a predetermined time after the printing preparatory operation.

Furthermore, the CPU 301 does not start feeding of a sheet until the sheet feed pickup roller 113 is moved to the contact position. On the other hand, if the sheet feed pickup roller 113 is in the contact position, the CPU 301 starts feeding of a sheet on the sheet feed tray 111 without the need to wait for the movement time of the sheet feed pickup roller 113. If, in step S5114, the CPU 301 determines that the sheet feed pickup roller 113 is in the contact position (YES in step S5114), the CPU 301 advances the processing to step S5117. In step S5117, the CPU 301 determines whether the print job is completed. If, in step S5117, the CPU 301 determines that the print job is not completed (NO in step S5117), the CPU 301 repeats the processing in step S5117. If, in step S5117, the CPU 301 determines that the print job is completed. (YES in step S5117), then in step S5118, the CPU 301 performs Lifting control to move the sheet feed pickup roller 113 to the separation position, and then ends the control processing.

As described above, according to the present exemplary embodiment, the following operation and determination are performed as a printing preparatory operation in advance of inputting of a job. More specifically, it is determined whether to allow the sheet feed pickup roller 113 to lower according to the destination information on the image forming apparatus and the sheet type at the timing at which the sheet size on the sheet feed tray 111 has been determined or even when feeding of a sheet from the sheet feed tray 111 is supposed. With this, unnecessary lowering processing for the sheet feed pickup roller 113 can be prevented from being performed and, thus, the sheet feed pickup roller 113 and the sheet can be prevented from coming into contact with each other. Then, an image defect caused by, for example, ink attached to the sheet, paper powder, or loading material of paper adhering to the sheet feed pickup roller 113, or a conveyance failure caused by slippage of the sheet feed pickup roller 113, can be prevented. Moreover, in a case where feeding of a sheet from the sheet feed tray 111 is supposed, the sheet size is determined, and the lowering of the sheet feed pickup roller 113 is "allowed", the sheet feed pickup roller 113 is caused to lower in advance of feeding of a sheet, so that the FCOT can be shortened.

As mentioned in the foregoing, according to the present exemplary embodiment, an image defect or a conveyance failure can be reduced without any decrease in user operability.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit or Japanese Patent Application No. 2015-225697 filed Nov. 18, 2015, which is hereby incorporated by reference herein in its entirety.

What is claimed is:

1. An image forming apparatus comprising:

a feeder including a tray configured to stack a sheet thereon and a pickup member configured to contact the sheet stacked on the tray and to feed the contacted sheet, wherein the feeder is configured to switch between a first state in which the pickup member and the sheet stacked on the tray are in contact with each other and a second state in which the pickup member and the sheet stacked on the tray are separate from each other;

a size determiner configured to determine a size of the sheet stacked on the tray;

a sheet type setter configured to set a type of the sheet stacked on the tray; and a controller configured to control the feeder, wherein, in a case where the type of the sheet set by the sheet type setter is a first type, the controller controls the feeder in such a way that the feeder switches from the second state to the first state when the size of the sheet is determined by the size determiner, and wherein, in a case where the type of the sheet set by the sheet type setter is a second type, the controller controls the feeder in such a way to cause the feeder to refrain from switching from the second state to the first state even when the size of the sheet is determined by the size determiner.

2. The image forming apparatus according to claim 1, further comprising a memory that stores switching information indicating whether to switch the feeder from the second state to the first state when the size of the sheet is determined by the size determiner while associating the switching information with the type of the sheet, wherein the controller controls whether to switch the feeder from the second state to the first state based on the type of the sheet set by the sheet type setter and the switching information stored in the memory.

3. The image forming apparatus according to claim 1, wherein the feeder includes a motor configured to cause the pickup member to lift and lower, wherein the feeder switches to the first state according to the pickup member lowering, and wherein the feeder switches to the second state according to the pickup member lifting.

4. The image forming apparatus according to claim 1, wherein the feeder includes a motor configured to cause the tray to lift and lower, wherein the feeder switches to the first state according to the tray lowering, and wherein the feeder switches to the second state according to the tray lifting.

5. The image forming apparatus according to claim 1, further comprising a receiver configured to receive a print job, wherein, in a case where a predetermined time has elapsed without the receiver receiving any print job after the feeder switches from the second state to the first state, the controller controls the feeder in such a way that the feeder switches from the first state to the second state.

6. The image forming apparatus according to claim 1, wherein the size determiner includes:

a size sensor configured to detect information required for determining the size of the sheet, a display unit configured to display candidates of the size of the sheet stacked on the tray based on the information detected by the size sensor, and a button configured to select a size of the sheet from among the candidates of the size displayed by the display unit, wherein the size determiner is configured to determine the size of the sheet according to the size of the sheet being selected by the button from among the candidates.

7. The image forming apparatus according to claim 1, wherein the sheet type setter includes:

a display unit configured to display candidates of the type of the sheet, and a button configured to select a type of the sheet from among the candidates of the type displayed by the display unit, and wherein the sheet type setter is configured to set the type of the sheet according to the type of the sheet being selected by the button from among the candidates.

8. The image forming apparatus according to claim 1, wherein the feeder includes a feeder configured to manually feed a recording sheet.

9. The image forming apparatus according to claim 1, wherein the sheet of the second type includes coated paper.

10. The image forming apparatus according to claim 1, further comprising a second memory that stores destination information indicating a region in which the image forming apparatus is to be used, wherein, in a case where the type of the sheet set by the sheet type setter is the first type and the destination information stored in the second memory indicates a first destination, the controller controls the feeder in such a way that the feeder switches from the second state to the first state when the size of the sheet is determined by the size determiner, and wherein, in a case where the type of the sheet set by the sheet type setter is the first type and the destination information stored in the second memory indicates a second destination, the controller controls the feeder in such a way that the feeder does not switch from the second state to the first state even when the size of the sheet is determined by the size determiner.

11. The image forming apparatus according to claim 1, further comprising a third sensor configured to detect a user operation supposed to be directed to execution of image formation, wherein, in a case where the user operation is detected by the third sensor and the type of the sheet set by the sheet type setter is the first type, the controller controls the feeder in such a way that the feeder switches from the second state to the first state when the size of the sheet is determined by the size determiner, and wherein, in a case where the user operation is detected by the third sensor and the type of the sheet set by the sheet type setter is the second type, the controller controls the feeder in such a way to cause the feeder to refrain from switching from the second state to the first state even when the size of the sheet is determined by the size determiner.

12. The image forming apparatus according to claim 11, wherein, in a case where the type of the sheet set by the sheet type setter is the first type, the controller controls the feeder in such a way that the feeder switches from the second state to the first state when the size of the sheet is determined by the size determiner, even if the user operation is not detected by the third sensor.

13. An image forming apparatus comprising:

a feeder including a tray configured to stack a sheet thereon and a pickup member configured to contact the sheet stacked on the tray and to feed the contacted sheet, wherein the feeder is configured to switch between a first state in which the pickup member and the sheet stacked on the tray are in contact with each other and a second state in which the pickup member and the sheet stacked on the tray are separate from each other;

a size determiner configured to determine a size of the sheet stacked on the tray;

a sheet type setter configured to set a type of the sheet stacked on the tray;

a memory that stores destination information indicating a region in which the image forming apparatus is to be used; and a controller configured to control the feeder, wherein, in a case where the type of the sheet set by the sheet type setter is a first type and the destination information stored in the memory indicates a first destination, the controller controls the feeder in such a way that the feeder switches from the second state to the first state when the size of the sheet is determined by the size determiner, and wherein, in a case where the type of the sheet set by the sheet type setter is the first type and the destination information stored in the memory indicates a second destination, the controller controls the feeder in such a way to cause the feeder to refrain from switching from the second state to the first state even when the size of the sheet is determined by the size determiner.

14. An image forming apparatus comprising:

a feeder including a tray configured to stack a sheet thereon and a pickup member configured to contact the sheet stacked on the tray and to feed the contacted sheet, wherein the feeder is configured to switch between a first state in which the pickup member and the sheet stacked on the tray are in contact with each other and a second state in which the pickup member and the sheet stacked on the tray are separate from each other;

a size determiner configured to determine a size of the sheet stacked on the tray;

a sheet type setter configured to set a type of the sheet stacked on the tray;

a detector configured to detect a user operation supposed to be directed to execution of image formation; and a controller configured to control the feeder, wherein, in a case where the type of the sheet set by the sheet type setter is a first type and the operation is detected by the detector, the controller controls the feeder in such a way that the feeder switches from the second state to the first state when the size of the sheet is determined by the size determiner, and wherein, in a case where the type of the sheet set by the sheet type setter is a second type and the operation is detected by the detector, the controller controls the feeder in such a way to cause the feeder to refrain from switching from the second state to the first state even when the size of the sheet is determined by the size determiner.

15. An image forming apparatus comprising:

a feeder including a tray configured to stack a sheet thereon and a pickup member configured to contact the sheet stacked on the tray and to feed the contacted sheet, wherein the feeder is configured to switch between a first state in which the pickup member and the sheet stacked on the tray are in contact with each other and a second state in which the pickup member and the sheet stacked on the tray are separate from each other;

a size determiner configured to determine a size of the sheet stacked on the tray;

a sheet type setter configured to set a type of the sheet stacked on the tray;

a memory that stores destination information indicating a region in which the image forming apparatus is to be used;

a detector configured to detect a user operation supposed to be directed to execution of image formation; and a controller configured to control the feeder, wherein, in a case where the type of the sheet set by the sheet type setter is a first type, the destination information stored in the memory indicates a first destination, and the operation is detected by the detector, the controller controls the feeder in such a way that the feeder switches from the second state to the first state when the size of the sheet is determined by the size determiner, and wherein, in a case where the type of the sheet set by the sheet type setter is the first type, the destination information stored in the memory indicates a second destination, and the operation is detected by the detector, the controller controls the feeder in such a way to cause the feeder to refrain from switching from the second state to the first state even when the size of the sheet is determined by the size determiner.

* * * * *